United States Patent [19]

Dettling

[11] 4,059,978

[45] Nov. 29, 1977

[54] TUBE BENDING MACHINE

[76] Inventor: Paul Dettling, Chaletstrasse 1, 8600 Dubendorf, Switzerland

[21] Appl. No.: 706,835

[22] Filed: July 19, 1976

[51] Int. Cl.[2] ..... B21D 7/04

[52] U.S. Cl. ..... 72/156; 72/158

[58] Field of Search ..... 72/149, 154, 156–158, 72/159, 150

[56] References Cited

U.S. PATENT DOCUMENTS

| | | | |
|---|---|---|---|
| 2,455,138 | 11/1948 | Perkins | 72/158 |
| 2,583,479 | 1/1952 | Froedge | 72/156 |
| 2,667,202 | 1/1954 | Froedge | 72/156 |

*Primary Examiner*—Milton S. Mehr

*Attorney, Agent, or Firm*—Herzig & Walsh Incorporated

[57] ABSTRACT

Portable hydraulic tube bending machine adjustable for bend angle and adjustable to tubing with and without collars and straight and pre-bent tubes, whereby complicated bendings can be carried out at the place of use and with a minimum of space.

8 Claims, 8 Drawing Figures

FIG. 2

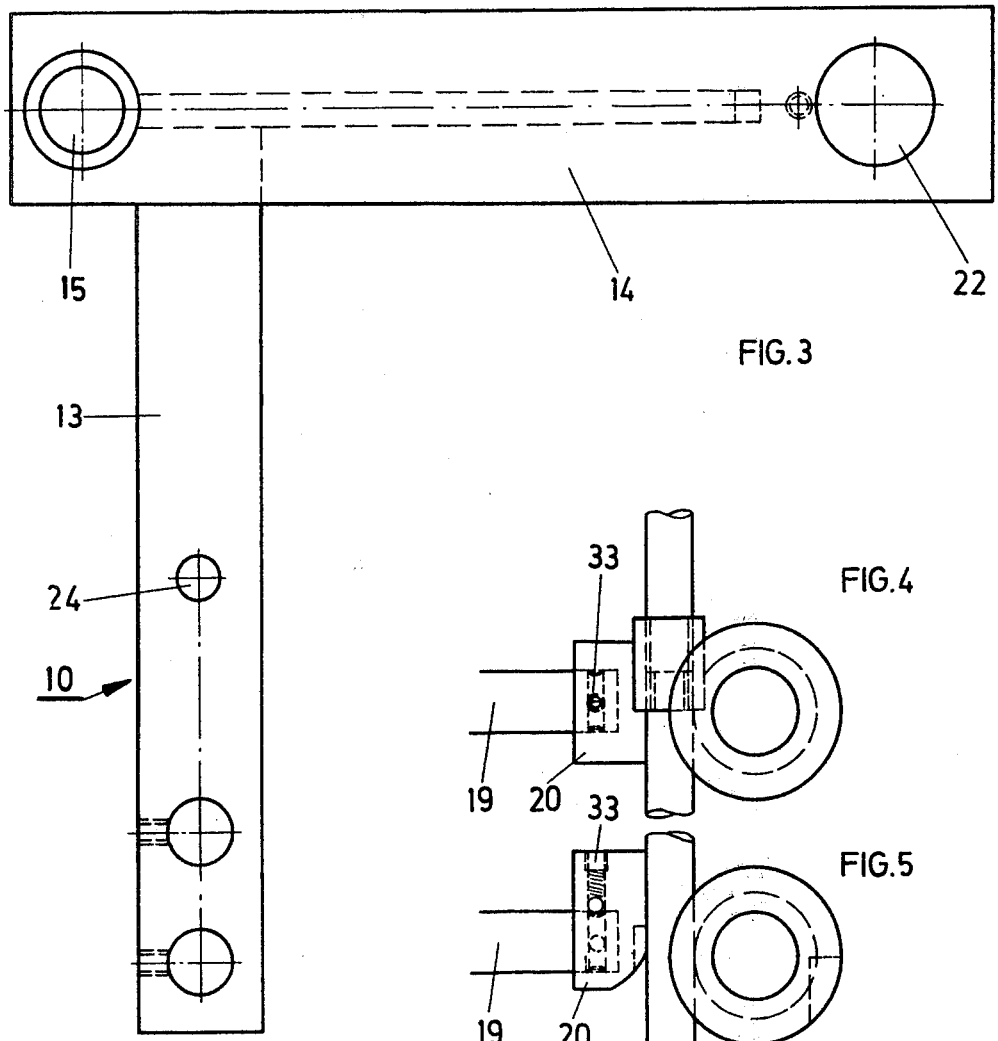
FIG. 3
FIG. 4
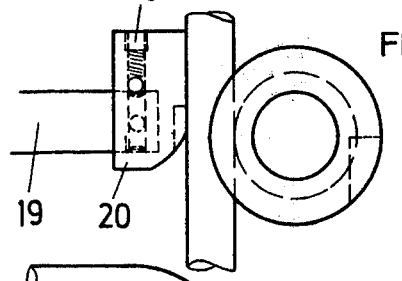
FIG. 5
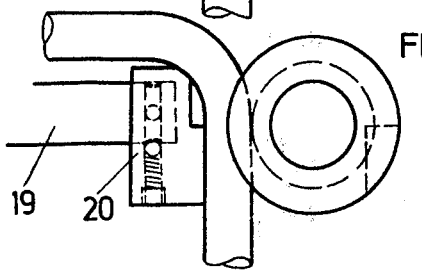
FIG. 6

TUBE BENDING MACHINE

SUMMARY OF THE INVENTION

An inexpensive portable pipe-bending machine for pipe processing plants which is particularly simple to operate and can be used for bending pipes into complicated shapes. Work can be carried out at the level of a standard bench and this prevents the operating personnel form becoming tired even after relatively long periods of work. In spite of all this, the machine may be transported relatively easily so it is used mainly on jigs. A single hydraulic pressure cylinder, which applies pressure to the pipe to be bent by means of a lever system, bends it to the desired angle, releases the die and returns to the starting position. The die, which has various contact pressure surfaces, may be regulated axially by means of a locating mechanism. Bends of complicated shapes may be made with these dies without adjusting the machine. The desired angle of the bend can be fixed by a bend gauge mounted on the framework.

Hydraulic tube bending machines as a general class are already known. Thus for example a tube bending machine having a hydraulic drive is known, in which two bending rollers are provided as well as a hydraulically actuated piston which grips the tube to be bent in the region between the two bending rollers. This has the disadvantage that during the bending process both limbs of the tube are equally sharply bent away, so that long tubes can be bent only in a cumbersome fashion and with the employment of a large working space. Moreover, complicated bendings can be achieved only very difficultly or indeed not at all.

An object of the invention is to provide a simple and portable tube bending machine which can be employed with great simplicity, which is portable, and with the employment of which even complicated tubing forms may be bent.

Other objects of the invention will become apparent as the description proceeds. These objects are achieved in accordance with the invention by providing a single hydraulic cylinder which acts through a system of levers in the first partial stroke of the driving stroke upon a pressing device so as to press one of the tubes to be bent against a bending roller, and in a second partial stroke swings a pivotally mounted bending arm around the axis of rotation of the bending roller, after a detent arrangement which arrests the bending arm until the end of the first partial stroke has been freed by the lever system.

A preferred embodiment of the invention is shown in the drawings. They are as follows:

FIG. 3 is a side view of the bending arm of the tube bending machine.

FIGS. 4, 5 and 6 show the forming head turned in various positions in accordance with FIG. 2.

Figure 1:
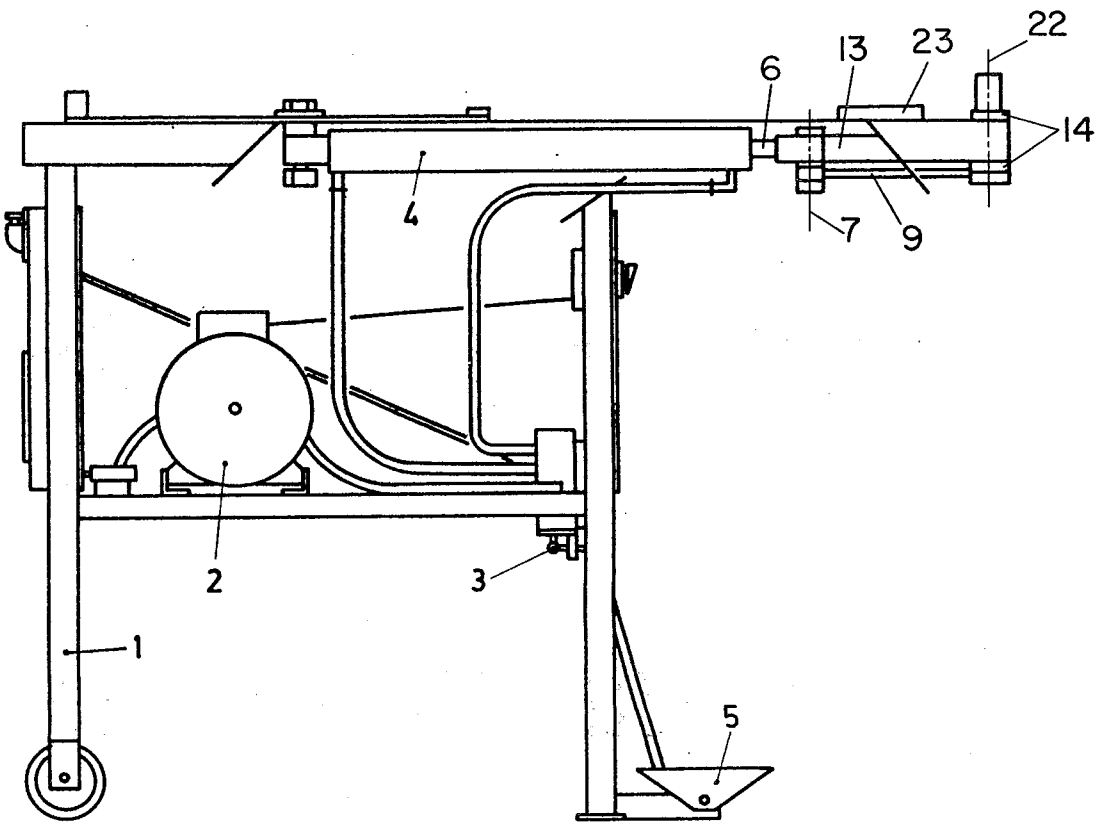
FIG. 1 is a side view of the embodiment to be described.

The portable tube bending machine in accordance with FIG. 1 comprises a stand 1, which has the form of a cart with two roller legs and two fixed legs. The stand bears a hydraulic pump 2, which is connected to a hydraulic cylinder 4 through a two-way valve 3. The valve 3 may be operated by a foot-pedal 5, which consists of a rocker which can be rocked to two positions, so that the hydraulic cylinder 4 can be advanced or retracted in accordance with the rocking of the pedal 5. The upper side of the stand 1 serves as a working platform or table, the details of which may be seen in FIGS. 2 through 6, inclusive.

Figure 2:
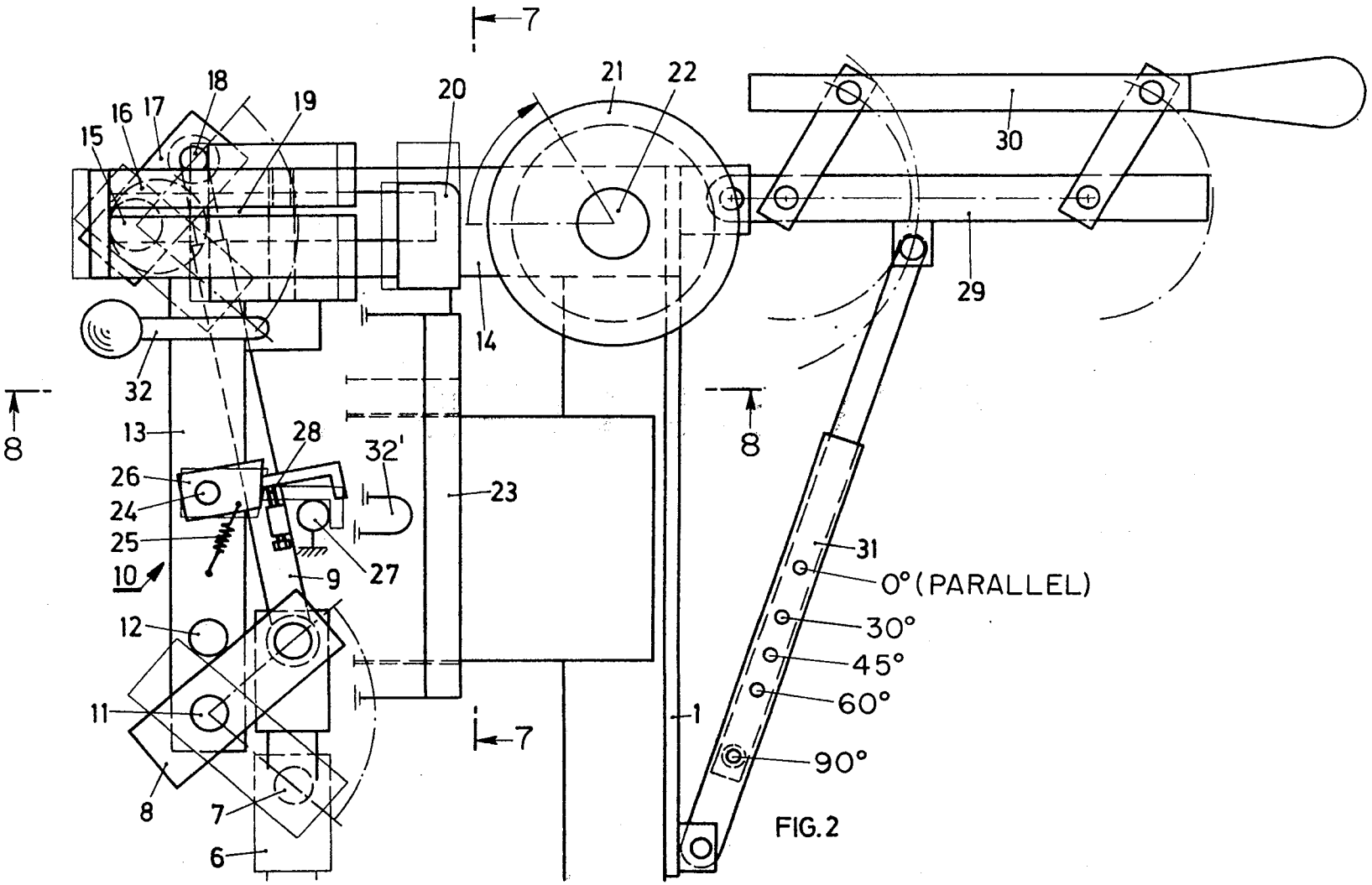
FIG. 2 is a plan view showing the essential functional elements of the tube bending machine.
Figure 7:
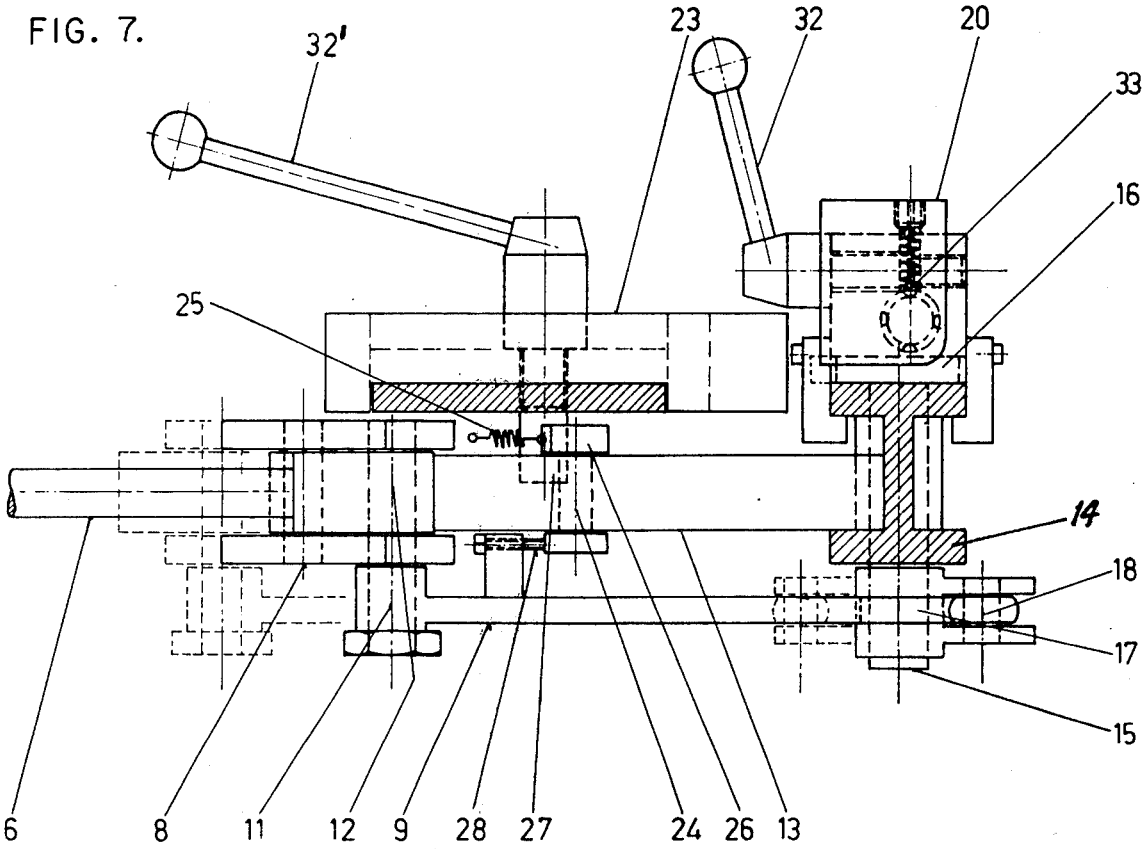
FIG. 7 is a section taken as indicated by the arrows on FIG. 2.
Figure 8:
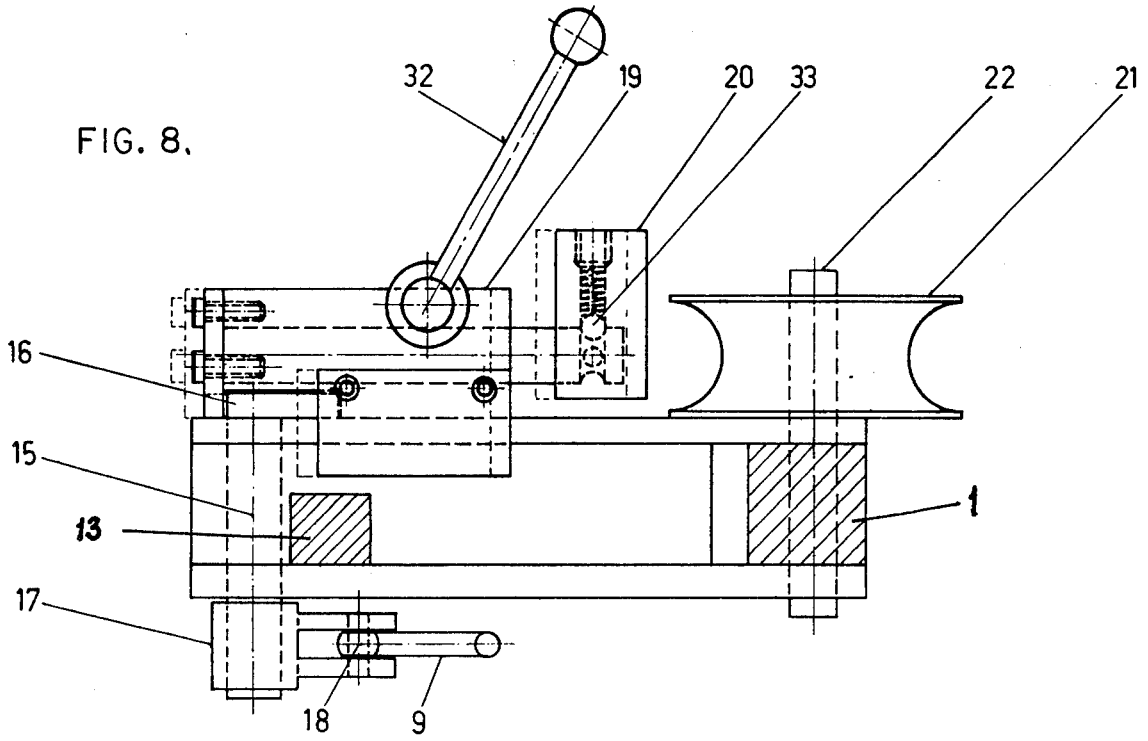
FIG. 8 is a section taken as indicated by the arrows on FIG. 2.

The piston rod 6 appearing in FIG. 2 and which belongs to the hydraulic cylinder 4 shown in FIG. 1 is, as may be seen in FIG. 2, connected through a linkage 7 with, on the one hand, a first lever 8 and on the other hand, with a pushrod 9. The lever 8 is linked to a bending arm 10, which is shown in detail in FIG. 3. Under the influence of the piston rod 6 the lever 8 can undergo only a limited swiveling motion about the bearing pins 11 on the bending arm 10, inasmuch as this swiveling motion is limited by an additional pin 12 attached to the bending arm 10. As may be seen from FIG. 3, the bending arm 10 comprises two legs 13 and 14 fixed at right angles to each other, and in which the leg 14 extends a short distance beyond the leg 13, to the left thereof as shown in FIG. 3. In this projecting portion a bearing 15 is provided for an eccentric pin 16, and moreover the eccentric pin is connected with a second lever 17, which runs approximately parallel to the first lever 8. The pushrod 9 which is connected with the first lever 8 is connected with the second lever 17 through a bearing 18. As a result of this connection both levers 8 and 17 undergo approximately equal angular rotations, so that in this fashion the eccentric pin 16 is rotated through corresponding angles, as soon as the piston rod 6 is actuated. FIG. 2 shows in the lightly drawn lines the position of the lever system at the beginning of a pressing stroke, while the heavy lines show the same elements at the end of the pressing stroke.

The front face of a forming rod 19 lies on the eccentric 16; and in accordance with the FIGS. 4, 5 and 6 bears a forming head 20 which is rotatable about the rod axis and is provided with a spring-loaded detent. A tube to be bent is pressed against a bending roller 21 by means of the forming head 20 pushed by the forming rod 19 and actuated by the eccentric 16, while the bending roller is rotatably secured in a bearing 22 on the leg 14 of the bending arm 10. During the bending process, which will be described below, one leg of the tube to be bent is held by an impact angle piece 23, which forms a continuation of the impact surface of the forming head 20.

On the first sidearm 13 of the bending arm 10 a detent means 26 tensioned by a spring 25 is rotatably secured by a bearing 24. At the commencement of the pressing stroke, when the pushrod 9 is in the lower starting position, the detent 26 latches against a fixed pin 27. During the course of the pressing stroke an impact pin 28 which is secured to the rod 9, (the pin 28 preferably being an adjustable screw) impacts against the detent 26 and lifts it away from the pin 27. At this instant, in which the tube to be bent has been pushed against the bending roller 21 by the forming head 20, the bending arm 10, which is driven by the piston rod 6 through the lever 8 and the impact pin 12, commences to turn about the fixed bearing 22. In this way the tube which is pressed between the forming head 20 and the bending roller 21 is bent to the radius dictated by the bending roller 21.

By moving the foot-pedal in the opposite direction the piston rod 6 is withdrawn, so that the forming head 20 is removed from the tube, the bending arm 10 is withdrawn to its starting position, and the detent 26 comes to rest over the pin 27. In order to achieve a given angle of bend a bending gage 29 is provided which has a parallel bar 30 which may be adjusted to the different bending radii. The bending gage 29 is adjustable to different angles of bend by means of the telescoping adjustment arm 31 which is fixed to the stand 1.

In order to adjust the position of the forming rod 19 so as to correspond to different diameters of the bending roller as well as to different sizes of tubing, the forming rod 19 may be locked in the desired position with respect to the leg 14 by means of a lever 32.

As may be seen from FIGS. 4, 5 and 6, the forming head 20 may have its several faces of different configurations, so that as it is rotated with respect to the forming rod 19 it presents different faces to the workplace; it may be locked in the selected position by the spring loaded detent 33. FIG. 4 shows the face of the forming head to be used with tubes having collars, while FIG. 5 shows the face to be used for normal bending and FIG. 6 shows the face to be used for bending a tube which has already been bent in the opposite direction.

The tube bending device as described and in accordance with the invention enables the work to be carried out at a normal table height such as for example 85 centimeters, so that even during prolonged operation the operator is not tired. Nevertheless, the machine is relatively light and is portable, so that it is particularly well adapted to being taken to various localities where the tubes are to be bent. Furthermore, the tube to be bent and after bending may be readily introduced into the machine and removed therefrom without obstruction by the bending roller or other elements of the device. Moreover, the tube may always be introduced from the same side. Still further, the device permits the tube to be grasped and pressed against the bending roller and subsequently bent all with the aid of a single hydraulic cylinder. Bending angles up to 100° may be achieved. The bending process takes at most 10 seconds.

It will be understood that the device has been described in terms of the bending of tubes, which term is to be taken generically to include tubes, tubing, pipes and even solid rods, of any material which may be given a permanent deformation by bending. Of greatest importance, of course, are materials such as steel, stainless steel, copper, brass, aluminum and the like.

While I have described the invention with the aid of a detailed illustrative example, I wish it to be understood that I do not desire to be limited to the exact details of construction shown and described, for obvious modifications will occur to a person skilled in the art.

Having described the invention, I claim:

1. A tube bending machine having hydraulic drive including a hydraulic cylinder characterized by the following: a single hydraulic pressure cylinder means, a lever system, a bending roller, the lever being operative in a first partial stroke of its driving stroke so as to press a tube to be bent against the bending roller, a pivotally mounted bending arm having detent means associated therewith, and the lever system being operative in a second partial stroke to swing the pivotally mounted bending arm around the axis of rotation of the bending roller, the detent means normally restraining the bending arm and being released by the said lever system at the end of the said first partial stroke.

2. A tube bending machine in accordance with claim 1 characterized by the following: the bending arm being in the form of an angle having two legs and being pivotally mounted near the end of one of said legs, a lever of the said lever system being linked to one end of the second said bending arm leg, and a stop pin whereby the range of movement of the said lever with respect to the said second leg is limited.

3. A tube bending machine in accordance with claim 2 including the following: a pushrod operatively connected to the said piston rod of the hydraulic cylinder, said pushrod being connected at its other end with a second lever of the said lever system and wherein the said second lever is rotatably mounted approximately at the point of intersection of the two legs of the said bending arm.

4. A tube bending machine in accordance with claim 3 including the following: an eccentric pin having a bearing mounting, a forming rod being provided on the generated surface, the forming rod having a forming head on the end remote from the eccentric pin, said forming head being adapted to press a tube to be bent against said bending roller.

5. A tube bending machine in accordance with claim 3 characterized by the following: the said second lever having a self-latching detent means and an adjustable impact pin positioned to release the detent means whereby the swinging motion of the bending arm about its bearing is initiated.

6. A tube bending machine in accordance with claim 4 characterized by the following: detent means whereby the forming head is axially adjustable and settable in a selected position.

7. A tube bending machine in accordance with claim 4 characterized by the following: the forming head is provided with a multiplicity of forming surfaces, the forming head being rotatable with respect to the forming rod and detent means whereby the forming head is settable in a selected position.

8. A tube bending machine in accordance with claim 1 including the following: a bending gauge adjustable in accordance with the selected bending angle, said bending gauge including an adjustable parallel bar settable to a selected bending radius.

* * * * *